US006129651A

United States Patent [19]

Denaro

[11] Patent Number: 6,129,651

[45] Date of Patent: Oct. 10, 2000

[54] PERFECT PUSH-UP APPARATUS

[75] Inventor: Salvatore V. Denaro, Wantagh, N.Y.

[73] Assignee: Salvatore Denaro, Wantagh, N.Y.

[21] Appl. No.: 09/176,717

[22] Filed: Oct. 22, 1998

[51] Int. Cl.[7] ..... A63B 26/00

[52] U.S. Cl. ..... 482/141

[58] Field of Search ..... 482/141, 142

[56] References Cited

U.S. PATENT DOCUMENTS 1,734,664 11/1929 Albach ..... 482/41
3,697,066 10/1972 Wieland ..... 272/63
4,358,106 11/1982 Shadford ..... 272/93
4,415,150 11/1983 Iezza ..... 272/63
5,226,868 7/1993 Montgomery ..... 482/141

*Primary Examiner*—Richard J. Apley
*Assistant Examiner*—Lori Baker

[57] ABSTRACT

Disclosed is an adjustable push-up exercise apparatus designed to accommodate users of all sizes and statures. The apparatus includes a planar base member which adjusts in size, and a pair of U-shaped handles extending upright from the base which are height adjustable. The handles fold down onto the base, minimizing storage space requirements.

4 Claims, 1 Drawing Sheet

PERFECT PUSH-UP APPARATUS

FIELD OF THE INVENTION

This invention relates to an apparatus used to perform push-ups. More particularly, it relates to a push-up apparatus which adjusts to the size of the user.

BACKGROUND OF THE INVENTION

Numerous devices have been disclosed which are useful in exercising and strengthening the human body. These devices range from simple weights which are lifted to build muscles, to highly complex machines designed to exercise and build specific muscles of the user. Significant numbers of these complex machines are available at commercial facilities where a fee is charged for their use. Many more exercise machines are marketed through the media for purchase by the individual user.

Examples of exercise devices which are disclosed in patents include U.S. Pat. No. 4,272,074 by Sferle describing a body building apparatus which includes a pivotally mounted rectangular frame.

In U.S. Pat. No. 4,750,736 Watterson shows a multiple purpose exercise machine which converts from a rowing machine to a leg raise exerciser.

Diodati in U.S. Pat. No. 5,072,933 discloses an exercising weight in which the total weight of the article is adjustable.

Thus, there exists an unmet need for an exercise apparatus which is simple in design, yet is adjustable to accommodate a wide variety of user body size.

SUMMARY OF THE INVENTION

The invention is an adjustable push-up exercise apparatus comprising a generally planar base member with top and bottom surfaces. The base member is divided into first and second sections, and is fitted with a base adjusting member to vary the base member size. A pair of height adjustable planar U-shaped handle members is mounted on the base member. Each handle has an open end and a closed end, and is rotatably attached by a first attachment member at the open end to the top surface of one section of the adjustable base member. The first attachment member allows each planar handle member to rotate between zero degrees and ninety degrees orientation relative to the planar base member. Further, each handle member is reversibly lockable by a first locking member at the open end to the top surface of one section of the adjustable base member. The first locking member reversibly secures the planar handle member at a ninety degrees orientation relative to the planar base member. The U-shaped handle member height is adjustable through an adjusting structure.

DESCRIPTION OF THE PREFERRED EMBODIMENTS

Figures 1, 2:
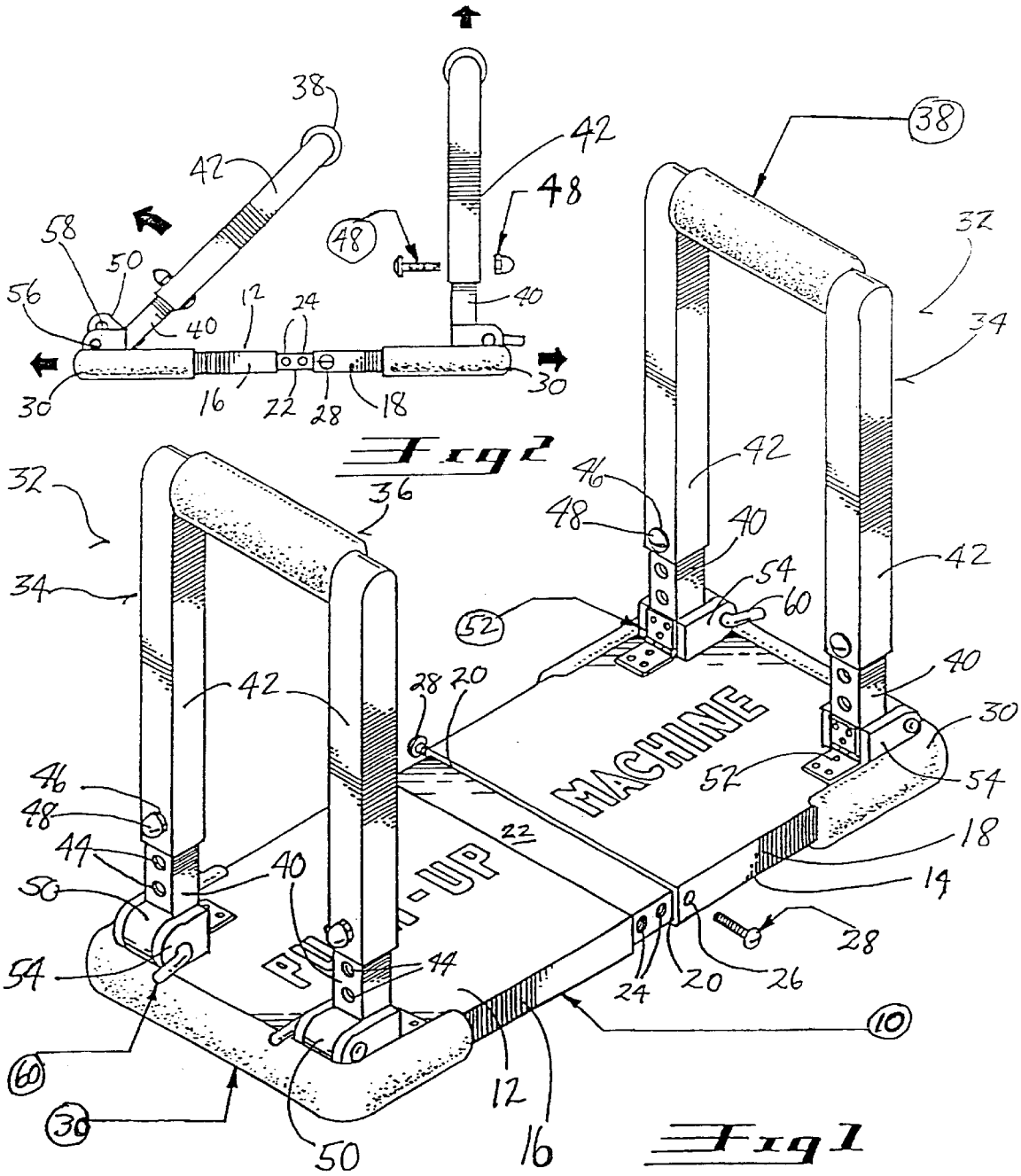
FIG. 1 is a perspective view of the exercise apparatus of the present invention.
FIG. 2 is a plan side view of the apparatus of the present invention.

The push-up exercise apparatus of the present invention is designed to accommodate users of all sizes and statures. The apparatus includes a planar base member and two U-shaped handle members extending upright from the base. The user grasps a handle with each hand and performs push-ups or other exercises.

The base member adjusts in size, thus varying the distance between the attached handle members, to fit all users. In addition, the height of the handle members is adjustable to provide additional options as to the exercises performed on the apparatus. Finally, the handle members fold down onto the base, minimizing storage space requirements. A detailed description of the invention follows.

Referring to FIG. 1, a perspective drawing of the adjustable push-up exercise apparatus is shown. The device comprises a planar base member 10 with top 12 and bottom 14 surfaces, with the base preferably rectangular in shape. The base 10 is divided into first 16 and second 18 sections of approximately equal size. At least one of the base sections, in this case section 18, is hollow with an aperture 20 on one side. The other base portion 16 has a slightly smaller portion 22 which fits within the aperture 20, allowing the overall size of the base member 10 to be varied by repositioning the smaller portion 22 of base section 16 within the aperture 20. The smaller portion 22 contains a series of holes 24 along each edge which align with a single hole 26 in each side of the hollow section 18. Thus the size of the base member 10 can be varied by repositioning the smaller portion 22 within the hollow section 18, and securing the two halves together by means of a pair of fasteners 28 inserted through the aligned holes in each portion. The base member 10 optionally is fitted with a pair of U-shaped rubber padding members 30 which wrap around the ends of the base member to prevent slippage of the apparatus during use.

Atop the base member 10 is fastened a pair of height adjustable planar U-shaped handle members 32, each with an open end and a closed end. Each handle member includes two leg portions 34, and a connecting hand grip portion 36 covered with a rubber pad 38. The leg portions 34 are telescoping in structure with a smaller internal leg member 40 inside a hollow outer leg member 42. Each internal leg member 40 extends from each outer leg member 42 at the open end of the handle member 32. Both the outer leg member 42 and the inner leg member 40 are preferably square in cross section, while the hand grip portion 36 is preferably round in cross section. Each internal leg member 40 has a series of evenly spaced holes 44 through it, with the holes located near the end extending from the outer leg member 42. Each outer leg member has one hole 46 through it near the end opposite the hand grip portion 36. Thus, the length of the leg portion 34 of the handle member 32 can be varied by extending the internal leg portion 40 a greater distance beyond the end of the outer leg portion 42 and securing a fastener 48 through the aligned holes in each leg member. This is shown in FIG. 2.

Each inner leg section 40 terminates in an enlarged end member 50 which is used to secure the handle member 32 to the base member 10. Each handle member 36 is secured at the open end to one section of the base member 10 at a side opposite the adjusting means located in the center of the base member 10. Each leg portion 34 is secured to the base member 10 by a hinge 52 fastened between the inner leg section 40 and the base 10, with the hinges 52 located on the sides of the planar U-shaped handle members closest the center of the base member 10. The hinges are positioned to allow the handle member 32 to rotate from a ninety degrees vertical orientation to a zero degrees horizontal orientation relative to the planar base member 10.

The enlarged end members 50 extends from the end of the inner leg section 40 opposite the point of attachment of the hinge 52 fastened thereto. Each enlarged end member 50 on the inner leg section 40 also fits into a bracket member 54 also secured to the base member 10. The bracket members

54 have two apertures 56 which coincide with an aperture 58 in the end member 50 in the portion opposite the hinge attachment. The U-shaped handle member 32 thus can be locked in a vertical orientation by inserting a pin member 60 through the holes in the bracket and the enlarged end member 50. This is best seen in FIG. 2 as a side view of the apparatus. Thus the combination of the hinges and locking brackets allow the U-shaped handle members to be securely locked in a vertical orientation relative to the base member for exercise use, and allows the handles to be folded down onto the base member for storage purposes.

While the invention has been particularly shown and described with reference to a preferred embodiment thereof, it will be understood by those skilled in the art that various changes in form and details may be made therein without departing from the spirit and scope of the invention.

I claim:

1. An adjustable push-up apparatus comprising:

a) a generally planar base member with top and bottom surfaces, wherein the base member engages the floor, said base member divided into first and second sections, and fitted with a third base member that is telescopic for providing an adjusting means to vary the size of said base member;

b) a pair of height adjustable upright support leg members, each with an open end and a closed end, each upright support leg member hingedly attached at one end to said base in a transverse position, said first attachment means allowing each upright support leg member to rotate between zero degree and ninety degree orientation relative to, said planar base member, each upright support leg member reversibly lockable to the top surface of one section of said adjustable base member with a fastening means that comprises a pin, said first locking means reversibly securing the upright support leg members at a ninety degree orientation relative to said planar base members;

c) adjusting means to vary the height of said upright support leg member, and d) a handgrip means handle member fixed to each pair of adjustable upright support leg members at an opposite end thereof.

2. The exercise apparatus of claim 1 wherein said first attachment means comprises a pair of hinge members fastened to said base member top surface and positioned such that one each hinge pair is secured to a first leg end of said upright support leg member and the other of each pair is secured to a second leg end of said upright support leg member, said hinge members positioned to allow said support leg members to fold essentially flat onto said top surface of said base member.

3. The exercise apparatus of claim 1 wherein said first locking means comprises a pair of bracket members fastened to said base member top surface and positioned such that one of each bracket pair reversibly accepts a first leg end of said upright support leg member and the other of each pair reversibly accepts a second leg end of said upright support leg member.

4. The exercise apparatus of claim 1 wherein said upright support leg member height adjusting means comprising telescoping leg members made up of a hollow outer leg member containing a movable smaller internal leg member therein, said outer and inner leg members each having a plurality of apertures there through, and a pin fastener means insertable through selected apertures in said outer and inner leg members, thereby providing adjusting means for the height of said upright support leg members.

* * * * *